US006486594B1

(12) United States Patent
Kang

(10) Patent No.: US 6,486,594 B1
(45) Date of Patent: Nov. 26, 2002

(54) STRUCTURE OF PLASMA LAMP OF MICROWAVE ILLUMINATION APPARATUS

(75) Inventor: Hyung Joo Kang, Kwangmyung (KR)

(73) Assignee: LG Electronics Inc. (KR)

( * ) Notice: Subject to any disclaimer, the term of this patent is extended or adjusted under 35 U.S.C. 154(b) by 187 days.

(21) Appl. No.: 09/709,176

(22) Filed: Nov. 10, 2000

(30) Foreign Application Priority Data

Nov. 26, 1999 (KR) ..... 99-52957

(51) Int. Cl.[7] ..... H01J 61/10
(52) U.S. Cl. ..... 313/231.31; 315/39; 315/111.21
(58) Field of Search ..... 313/231.31, 231.61, 313/234, 246, 248, 607, 568, 570; 315/39, 248, 111.21, 111.81

(56) References Cited

U.S. PATENT DOCUMENTS 5,334,913 A 8/1994 Ury et al. ..... 315/248
5,686,793 A 11/1997 Turner et al. ..... 313/570

FOREIGN PATENT DOCUMENTS

WO WO9727618 A1 7/1997

*Primary Examiner*—Nimeshkumar D. Patel
*Assistant Examiner*—Thelma Sheree Clove
(74) *Attorney, Agent, or Firm*—Ostrolenk, Faber, Gerb & Soffen, LLP

(57) ABSTRACT

A plasma lamp structure of a microwave illumination apparatus including: mirror mounting portions formed to be concavo-convex at regular intervals so as to partially contact the bottom surface of a mirror in a supporting manner at the front end portion of a protrusion of a microwave guide in which microwave is guided toward a resonator; and support pieces formed to supportedly press the upper surface of the mirror mounted on the mirror mounting portion on the inner circumferential surface of the resonator that is extrapolated at the microwave guide. By having such structure, no space is allowed between the front end portion of the protrusion and the support pieces where the mirror is fixed, and a spark can be prevented from occurring and the mirror can be firmly supported.

2 Claims, 3 Drawing Sheets

STRUCTURE OF PLASMA LAMP OF MICROWAVE ILLUMINATION APPARATUS

BACKGROUND OF THE INVENTION

1. Field of the Invention

The present invention relates to a plasma lamp of a microwave illumination apparatus, and more particularly, to a structure of a plasma lamp of a microwave illumination apparatus which is capable of preventing a spark in a plasma lamp as well as ensuring that a mirror is firmly mounted in the lamp.

2. Description of the Background Art

Recently, a microwave illumination apparatus having an electrodeless bulb installed in a resonator has been developed which has a long duration and an excellent luminous efficiency.

FIG. 1 is a plan view of a general microwave illumination apparatus in accordance with a conventional art.

As shown in the drawing, the microwave illumination apparatus includes a high pressure generating unit 2 disposed at one side of the front side in a case 1 in a predetermined shape; a microwave generating unit 3 disposed at the other side of front side in the case 1, for generating a microwave by virtue of the high pressure generated from the high pressure generating unit 2; a microwave guide 4 disposed between the high pressure generating unit 2 and the microwave generating unit 3 to generate the microwave generated from the microwave generating unit 3, and having a protrusion 4*a* in a cylindrical form protruded outwardly of the case 1; a resonator 5 having holes in a comb form, of which one end is formed in a closed cylindrical form of which opening side is extrapolated to the protrusion 4*a* of the microwave guide 4, so as to resonate the microwave guided through the microwave guide 4; a reflector 6 installed at the front side of the case 1, covering the outer side of the resonator 5; an electrodeless bulb 7 installed inside the resonator 5, of which one end is fixed at a first motor 9 (to be described), and filled with gas excited by the microwave resonated in the resonator 5; a mirror 8 installed inside the resonator 5 for reflecting the light generated form the electrodeless bulb 7; a first motor for rotating the electrodeless bulb 7; a cooling fan 10 installed at the rear side of the case 1, corresponding to the microwave guide 4, for generating air to cool the heat generated at the high pressure generating unit 2 and at the microwave generating unit 3; a second motor 11 for rotating the cooling fan 10; an air guide duct 12 for guiding the air discharged from the cooling fan 10 to the high pressure generating unit 2 and to the microwave generating unit 3; and exhaust outlets 13 and 13' disposed at the both sides of the front side of the case 1, for discharging the air that cooled the high pressure generating unit 2 and the microwave generating unit 3.

The plasma lamp including the microwave guide 4, the resonator 5 and the electrodeless bulb 7 of the microwave illumination apparatus constructed as described above will now be explained in detail with reference to the accompanying drawings.

FIG. 2 is a sectional view showing a structure of a general plasma lamp of a microwave illumination apparatus in accordance with a conventional art.

As shown in the drawing, the conventional plasma lamp has a structure that a step portion 4*b* is formed at the front end portion of the protrusion 4*a* of the microwave guide 4, on which the marginal circumferential portion of a mirror 8 is mounted.

On the inner circumferential surface of the opening side of the resonator 5 that is extrapolated to the protrusion 4*a* of the microwave guide 4, an adiabatic support piece 5*a* is circularly protruded to the central axis of the resonator 5 or protrusively formed at regular intervals, so that it supportedly presses the upper surface of the mirror 8 that is mounted on the step portion 4*b* of the front end of the protrusion 4*a* of the microwave guide 4.

The operation of the microwave illumination apparatus having such a plasma lamp structure as described above will now be described.

When power is supplied from an external source to the high pressure generating unit 2, the high pressure generating unit 2 generates a high pressure and provides it to the microwave generating unit 3. And then, the microwave generating unit 3 generates microwave by virtue of the supplied high pressure.

Thusly generated microwave is guided to the microwave guide 4 and then transferred to the resonator 5 extrapolated at the protrusion 4*a* of the microwave guide 4.

Accordingly, the microwave is resonated inside the resonator 5, exciting the gas filled in the electrodeless bulb 7 placed inside the resonator 5, so as to change it to a light energy, thereby discharging light.

The light generated at the electrodeless bulb 7 is reflected on the mirror 8 in the forward direction and then reflected in one direction by the reflector 6.

The resonator 5 resonates the microwave and serves to prevent the microwave from leaking outside as well as transferring the light generated at the electrodeless bulb 7 outwardly at its maximum.

While the above operation is performed, the high pressure generating unit 2 and the microwave generating unit 3 are heated.

Therefore, in order to cool the high pressure generating unit 2 and the microwave generating unit 3, the second motor 11 is driven. As the second motor 11 is driven, the cooling fan 10 is rotated, by which the cool air cools the high pressure generating unit 2 and the microwave generating unit 3 and then is discharged to the reflector 6 through the exhaust outlets 13 and 13' of the case 1.

The air discharged to the reflector 6 cools the reflector 6 as well. Then, as the reflector 6 is cooled, the resonator 5 within the reflector 6 and the mirror 8 heated by the hear generated from the electrodeless bulb 7 within the resonator 5 are accordingly cooled.

In this respect, the reflector 6 is made of aluminum which has a property that heat transmission is made quick. Thus, the reflector 6 is quickly heated, while easily cooled by the air discharged through the exhaust outlets 13 and. 13', according to which the reflection mirror 8 is quickly cooled.

However, with the conventional microwave illumination apparatus having the above plasma lamp structure, since there exists a space (a gap) between the protrusion of the microwave guide and the support piece of the resonator where the mirror is mounted, microwave is charged in the space, causing a problem that spark is generated therein.

In addition, because of the space, the mirror is not firmly and supportedly mounted, degrading a stability and reliability of the device.

SUMMARY OF THE INVENTION

Therefore, an object of the present invention is to provide a plamsa lamp structure of a microwave illumination apparatus in which there is no space between a protrusion of a microwave guide and support piece formed in the inner circumferential surface of a resonator where a mirror is mounted, so that microwave is not discharged therein, thereby preventing a spark.

Another object of the present invention is to provide a plasma lamp structure of a microwave illumination apparatus in which a mirror is firmly mounted to thereby improve a stability of a device.

To achieve these and other advantages and in accordance with the purpose of the present invention, as embodied and broadly described herein, there is provided a plasma lamp structure of a microwave illumination apparatus including: mirror mounting portions formed to be concavo-convex at regular intervals so as to partially contact the bottom surface of a mirror in a supporting manner at the front end portion of a protrusion of a microwave guide by which microwave is guided to a resonator; and support pieces formed to supportedly press the upper surface of the mirror mounted on the mirror mounting portion on the inner circumferential surface of the resonator that is extrapolated at the microwave guide.

In the above plasma lamp structure of a microwave illumination apparatus, the support pieces contact the upper surface of the mirror, corresponding to groove portions between each of the mirror mounting portions.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Figure 1:
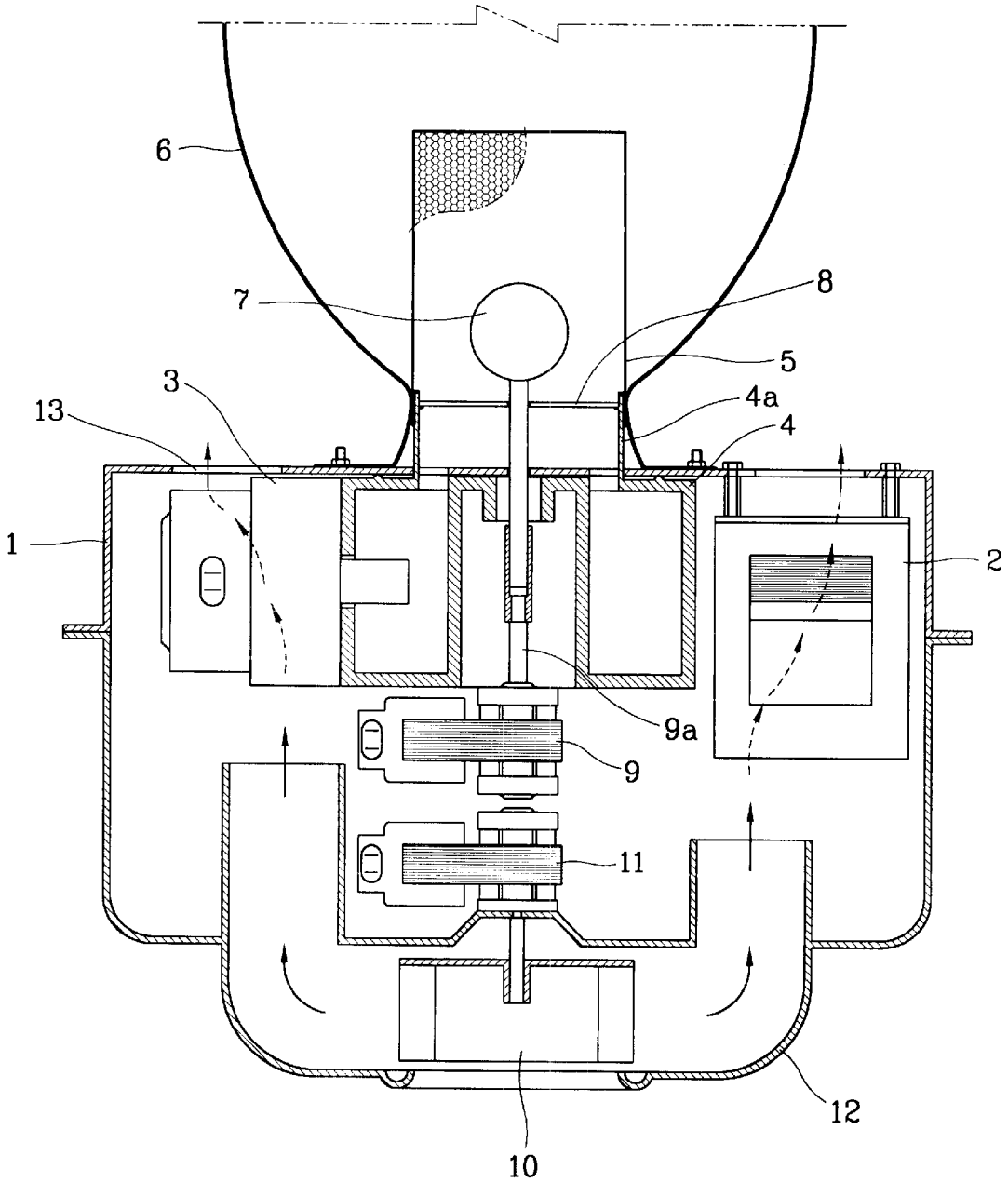
FIG. 1 BACKGROUND ART
FIG. 1 is a plan view showing a construction of a general microwave illumination apparatus in accordance with a conventional art.
Figure 2:
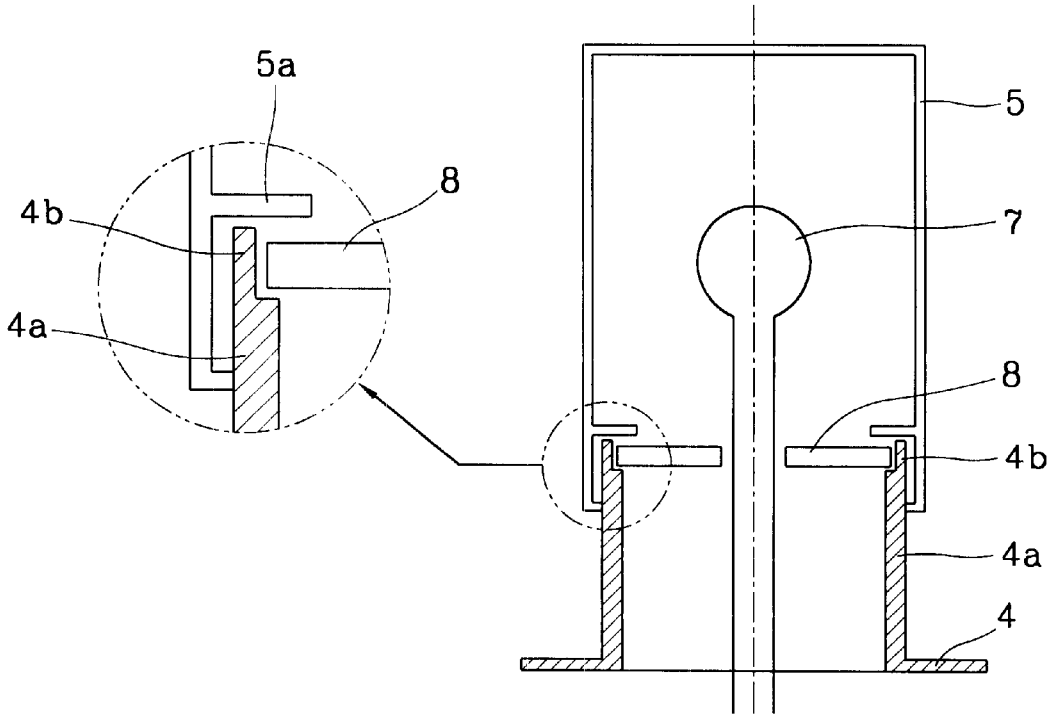
FIG. 2 BACKGROUND ART
FIG. 2 is a sectional view showing a plasma lamp structure of the microwave illumination apparatus in accordance with the conventional art.

Reference will now be made in detail to the preferred embodiments of the present invention, examples of which are illustrated in the accompanying drawings.

The plasma lamp structure of a microwave illumination apparatus in accordance with the present invention will now be described with reference to the accompanying drawings.

The other parts of the microwave illumination apparatus of the present invention except for the plasma lamp structure are the same as those of the conventional art, for which, thus, descriptions are omitted, and same reference numerals are given for the same elements as those in the conventional art.

Figure 3A:
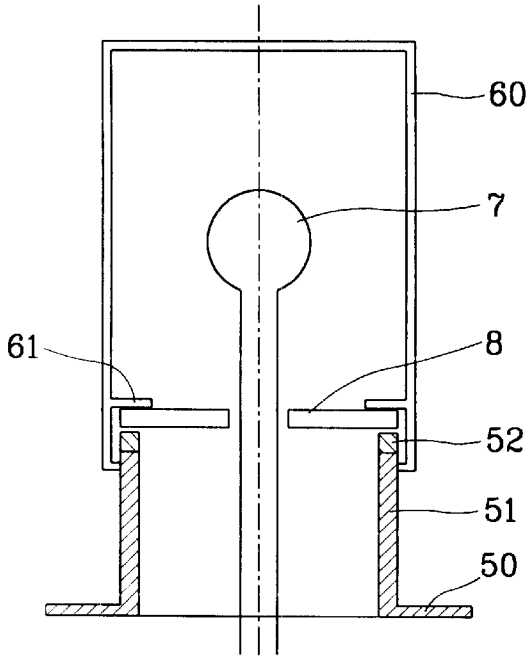
FIG. 3A is a sectional view showing a plasma lamp structure of a microwave illumination apparatus in accordance with the present invention.
Figure 3B:
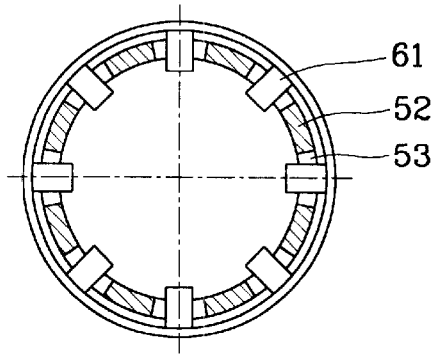
FIG. 3B is a plan view showing the plasma lamp structure of a microwave illumination apparatus in accordance with the present invention.

FIG. 3A is a sectional view showing a plasma lamp structure of a microwave illumination apparatus in accordance with the present invention, and FIG. 3B is a plan view showing the plasma lamp structure of a microwave illumination apparatus in accordance with the present invention.

As shown in the drawings, the plasma lamp has a structure that the mirror mounting portions 52, on which the mirror 8 is mounted, are protrusively formed at regular intervals at the front end portion of the protrusion 51 of the microwave guide 50 for guiding microwave wave generated by a microwave generating unit (not shown) to the resonator 60. Accordingly, non-contacting portions, that is, a groove portions 53, are formed between the mirror mounting portions 52, which do not contact the mirror 8.

On the inner circumferential surface of the opening side of the resonator 60, support pieces 61 are protrusively formed at regular intervals to a degree toward the central axis of the resonator 60 in a manner that they supportely contact the upper surface of the mirror 8 mounted on the mirror mounting portions 52 of the microwave guide 50.

In this respect, the support pieces 61 of the resonator 60 are formed at corresponding intervals to those of the mirror mounting portions 52 of the microwave guide 50.

Coupling process of the plasma lamp structure of the microwave illumination apparatus in accordance with the present invention will now be described.

First, the mirror 8 is mounted on the mirror mounting portions 52 formed at the front end portion of the protrusion 51 of the microwave guide 50. Then, the opening side of the resonator 60 is extrapolate at the outer surface of the protrusion 51 of the microwave guide 50, so that the support pieces 61 of the resonator 60 contact the upper surface of the mirror 8 to thereby be mounted.

In this respect, the support pieces 61 of the resonator 60 contact the upper surface of the mirror 8, corresponding to the groove portions 53 between the mirror mounting portions 52, while the bottom surface of the mirror 8 contact the mirror mounting portions 52 of the protrusion 51.

Accordingly, the support pieces 61 of the resonator 60 are positioned between each of the mirror mounting portions 52 of the protrusion 51 of the microwave guide 50, so that the mirror 8 can be firmly mounted thereto.

As so far described, according to the plasma lamp structure of the microwave illumination apparatus of the present invention, in order to fixedly mount the mirror, the mirror is mounted on the mirror mounting portions formed concavo-convex at regular intervals at the front end portion of the protrusion of the microwave guide, and then the support pieces of the resonator, that are to supportedly press the: upper surface of the mirror, are mounted to be corresponded between the mirror mounting portions, by which no space is allowed between the front end portion of the protrusion and the support pieces where the mirror is fixed. By doing that, a spark can be prevented from occurring and the mirror can be firmly supported.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalence of such meets and bounds are therefore intended to be embraced by the appended claims.

What is claimed is:

1. A plasma lamp structure of a microwave illumination apparatus comprising:

mirror mounting portions formed to be concavo-convex at regular intervals so as to partially contact the bottom surface of a mirror in a supporting manner at the front end portion of a protrusion of a microwave guide by which microwave is guided to a resonator; and support pieces formed to supportedly press the upper surface of the mirror mounted on the mirror mounting portions on the inner circumferential surface of the resonator that is extrapolated at the microwave guide.

2. The plasma lamp structure according to claim 1, wherein the support pieces contact the upper surface of the mirror, corresponding to groove portions between each of the mirror mounting portions.

* * * * *